US005567338A

United States Patent [19]

Idebro et al.

[11] Patent Number: 5,567,338

[45] Date of Patent: Oct. 22, 1996

[54] METHOD FOR CONTROLLING THE MICROWAVE FEED IN A MICROWAVE OVEN, AND MICROWAVE OVEN WITH SUCH CONTROL

[75] Inventors: Mats G. Idebro, Linkoping; Tim P. Sundstrom, Norrkoping, both of Sweden

[73] Assignee: Whirlpool Europe B.V., Veldhoven, Netherlands

[21] Appl. No.: 496,145

[22] Filed: Jun. 28, 1995

[30] Foreign Application Priority Data

Jun. 29, 1994 [SE] Sweden ..... 9402309

[51] Int. Cl.[6] ..... H05B 6/74

[52] U.S. Cl. ..... 219/718; 219/751; 219/752

[58] Field of Search ..... 219/718, 715, 219/702, 703, 751, 752, 753, 754, 755, 719

[56] References Cited

U.S. PATENT DOCUMENTS

| | | | |
|---|---|---|---|
| 3,569,656 | 3/1971 | White et al. | 219/718 |
| 3,927,291 | 12/1975 | Peterson | 219/754 |
| 4,507,531 | 3/1985 | Teich et al. | 219/718 |
| 4,714,811 | 12/1987 | Gerling et al. | 219/754 |
| 4,724,291 | 2/1988 | Inumada | 219/718 |
| 5,166,484 | 11/1992 | Young et al. | 219/718 |

FOREIGN PATENT DOCUMENTS

| | | | |
|---|---|---|---|
| 0049551 | 4/1982 | European Pat. Off. | H05B 6/68 |
| 0327168 | 8/1989 | European Pat. Off. | H05B 6/68 |

*Primary Examiner*—Philip H. Leung
*Attorney, Agent, or Firm*—Mark A. Davis; Robert O. Rice; Stephen D. Krefman

[57] ABSTRACT

A method for controlling the microwave feed in a microwave oven, as well as a microwave oven for implementing the method, is disclosed. The power level (P) of the microwaves is controlled by periodic activation or inactivation of the microwave radiation source of the oven during a sequence of control cycles. The oven has a rotary bottom plate carrying the food or dish, and/or a rotary field agitator or aerial. The heating uniformity is improved by adjusting to one another the duration of the control cycle and the revolution time of the bottom plate or of the field agitator or aerial, while taking into consideration the aimed-at power level. In a procedure composed of several steps with different power levels and heating times, the heating times of the different steps are also adjusted to the current control-cycle duration.

19 Claims, 4 Drawing Sheets

METHOD FOR CONTROLLING THE MICROWAVE FEED IN A MICROWAVE OVEN, AND MICROWAVE OVEN WITH SUCH CONTROL

BACKGROUND OF THE INVENTION

This invention relates to a method for controlling, in a microwave oven, the feeding of microwaves to the oven cavity, the oven comprising a microwave radiation source and a control unit for controlling the microwave feed, means being arranged in the cavity for bringing about a periodically-varying microwave exposure of the food or dish during heating, and a desired power level below full power of the fed microwaves being produced by periodic activation of the microwave radiation source during a control cycle that is part of a sequence of control cycles. The periodically-varying microwave exposure may be due to a periodic movement of the food, e.g. produced by a rotary bottom plate carrying the food or dish, or be due to a periodic variation of the microwave-field distribution in the cavity, e.g. produced by a rotary field agitator or aerial which usually is disposed at the ceiling or bottom of the cavity adjacent to where the microwaves are fed to the cavity. Combinations of these effects may also be used.

The invention further concerns a microwave oven having a control unit operating in accordance with the inventive method.

A general problem in microwave ovens is to achieve a microwave distribution in the cavity that optimises the uniformity of the heating of the food or dish placed in the cavity. If the microwave distribution is uneven, there will be "hot" and "less hot" zones in the cavity, and the parts of food located in these different zones will be heated to a different extent. This problem is aggravated by the fact that the microwave properties, the volume and the weight of the food, as well as the receptacle containing the food, affect the microwave distribution in the cavity. Even though it is possible to achieve a good microwave distribution in some specific cases of operation by suitable dimensioning of the cavity and its microwave-feed system, the problem still remains, the number of conceivable cases being virtually unlimited. This results in non-uniform heating of the food or dish.

A common way of improving the heating uniformity is to introduce a so-called rotary bottom plate in the oven cavity. The food or dish is then placed on the bottom plate, which rotates during the heating procedure. Since the food is thus rotated, its different parts will pass both the "hot" and the "less hot" zones during the heating procedure. Such bottom plates are, inter alia, used in the applicant's microwave ovens of type designations VIP20 and VIP 27. Alternatively, the heating uniformity can be improved by manipulating the microwave-field distribution in the cavity with the aid of a rotary field agitator or aerial, which may be disposed in the ceiling or bottom of the cavity adjacent to where the microwaves are fed to the cavity, so as to "agitate" or spread the microwaves. SE Patent 8006994-1 teaches such an oven construction. Thus, the microwave-field distribution in the cavity is varied periodically, as a function of the speed of rotation of the bottom plate or of the field agitator or aerial.

Different heating procedures require an adjustment of the power level of the microwaves fed to the cavity. During one and the same procedure, different power levels may be used during different periods of the procedure. A common way of achieving different power levels of the microwaves fed to the cavity is to divide the cooking procedure into control cycles and activate the microwave radiation source (normally a magnetron) of the oven periodically during these cycles. The power level is then determined by the average power of each cycle. SE Patent 8800323-1 teaches a microwave oven with such power control. This method of power control will be described in more detail below.

However, the problem of non-uniform heating can be aggravated by using the above power control in a microwave oven having a rotary bottom plate or a field agitator or aerial. In general, this is due to an interaction between the revolution time and the duration of the control cycle (normally in the same order), which may entail that a certain part of the food or dish periodically is found in the same part of the cavity volume during that interval of the control cycle when microwaves are fed to the cavity.

A rotary bottom plate is commonly operated with the aid of a synchronous motor imparting a constant speed of rotation, typically of about 5–6 revolutions/min, to the bottom plate, which means that the constant revolution time typically is 10–12 sec. In the above power control, the duration of the control cycle usually is 15–30 sec, i.e. substantially of the same order as the revolution time mentioned above.

An obvious solution to this problem would be to use a much shorter duration of the control cycle, so that the microwave radiation source, which normally is a magnetron with an output power in the order of 1 kW, would have to be switched on and off at a fairly high frequency. There are, however, many factors that tell against such a solution: the wear of the magnetron component increases and drastically reduces its service life; the mains operators in different countries do not allow too-rapid switching of the current power level, since this has a considerable interfering effect on the mains; and the food or dishes involved have limited thermal conductivity, which means that a certain time is needed to distribute or even out the supplied microwave energy in order to achieve good heating results.

SUMMARY OF THE INVENTION

The object of the invention is to essentially eliminate the problem of non-uniform heating in a microwave oven with power control of the above type, i.e. "pulsing" or periodic switching on and off of the microwave radiation source to produce power levels below full power.

According to the invention, this object is attained by a method which is of the type described by way of introduction and is characterised by adjusting to one another the duration of each control cycle and the variation period of the microwave exposure in order to improve heating uniformity, this adjustment consisting in so choosing the relationship between said duration and said variation period that an optional part of the food or dish is located within every sector of a revolution during essentially the same amount of the total activation time of the microwave radiation source during a heating procedure.

In a microwave oven whose cavity is provided with a rotary bottom plate carrying the food or dish during heating and in which a periodically-varying microwave exposure is brought about by the rotation of the bottom plate, the inventive method is characterised by improving the heating uniformity by adjusting to one another the duration of the control cycle and the revolution time of the bottom plate. In a microwave oven whose cavity is provided with a rotary field agitator or aerial and in which a periodically-varying microwave exposure of the food or dish is brought about by the rotation of the field agitator or aerial, the inventive method is characterised by improving the heating uniformity by adjusting to one another the duration of the control cycle and the revolution time of the field agitator or aerial.

As mentioned in the foregoing, the rotary bottom plate is commonly driven at constant speed by means of a synchronous motor. A preferred mode of implementation of the inventive method, which takes this fact into account and in which each control cycle is divided into an activating period and a resting period whose mutual relationship determines the current power level, is characterised by so choosing the duration of the control cycle in relation to the revolution time of the bottom plate that the revolution sectors corresponding to the activating periods of the microwave radiation source are substantially evenly distributed over the bottom plate during a heating procedure. In another mode of implementation of the inventive method, such a substantially even distribution of the revolution sectors can be achieved by so choosing the duration of the control cycle that successive activating periods correspond to substantially adjoining revolution sectors. In yet another, and further optimised, mode of implementation, these revolution sectors are located substantially diametrically in relation to one another.

Other preferred modes of implementation of the inventive method are stated in the appended claims.

Within the scope of the invention, the desired adjustment may also be achieved by the alternative or additional step of varying the speed of rotation of the bottom plate or of the field agitator or aerial.

According to the invention, a microwave oven comprises a cavity, a microwave radiation source, a control unit for controlling the feeding of microwaves to the cavity, and means arranged in the cavity for bringing about a periodically-varying microwave exposure of the food or dish during heating, the control unit being adapted to produce a microwave power level below full power by periodic activation of the microwave radiation source during a control cycle that is part of a sequence of control cycles, and is characterised in that the duration of each control cycle has such a relationship to the variation period of the microwave exposure that an imaginary part of the food or dish is located within every sector of a revolution during essentially the same amount of the total activation time of the microwave radiation source.

A preferred embodiment of the microwave oven according to the invention, in which said means comprise a rotary bottom plate carrying the food or dish during heating, and the rotation of the bottom plate brings about the periodically-varying microwave exposure, is characterised in that the duration of the control cycle is related to the revolution time of the bottom plate. Another preferred embodiment of the microwave oven according to the invention, in which said means comprise a rotary field agitator or aerial whose rotation brings about the periodically-varying microwave exposure, is characterised in that the duration of the control cycle is related to the revolution time of the field agitator or aerial.

In a microwave oven according to the invention, the control unit may include a microprocessor having an associated program store and adapted for selecting preprogrammed automatic heating procedures. Such a procedure may consist of a sequence of steps, each having an associated power level and heating time. The different power levels are produced by dividing each control cycle into an activating period and a resting period, whose mutual relationship determines the power level. A preferred embodiment of such a microwave oven, in which the duration of each activating period equals part of the revolution time, is characterised in that the microprocessor, for each step, is programmed to: establish the repetition interval, in terms of control-cycle durations, at which the activating periods occur at the same places of the revolution; choose an adjusted heating time equal to an integer multiple of said repetition interval within the heating time of the step; add the remainder of the heating time to the heating time of the following step; and introduce the heating time remaining from the last step as inactive time within the total heating time. By thus taking into consideration also the heating times of the individual steps, as well as the total heating time, when choosing the duration of the control cycle, the heating uniformity is further optimised.

Other preferred embodiments of the microwave oven according to the invention are stated in the appended claims.

This invention is based on the insight that the relationship between the periodicity of the power control and the rotation of the bottom plate or of the field agitator or aerial in an oven of the above type is of great importance to the heating uniformity in the oven. Also, it has been found that the heating uniformity can be much improved by adjusting these periodicities to one another, which can be achieved at a low cost in a microprocessor-controlled oven by using an expanded control program for the microprocessor. A further insight is that the heating time during such a procedure, as well as the respective heating times of different steps in such a procedure, may have an adverse effect on the heating uniformity, which can be eliminated by taking also these heating times into consideration when making the above adjustment.

Non-restricting embodiments of the invention will be described in more detail below with reference to the accompanying drawings, in which

DETAILED DESCRIPTION OF THE PREFERRED EMBODIMENTS

For the sake of simplicity, the following description will focus on microwave ovens having a rotary bottom plate. However, the content of the following description can, by measures of convenience, be directly applied to microwave ovens having a rotary field agitator or aerial, as well as to microwave ovens having both a rotary bottom plate and a rotary field agitator or aerial.

Figure 1:
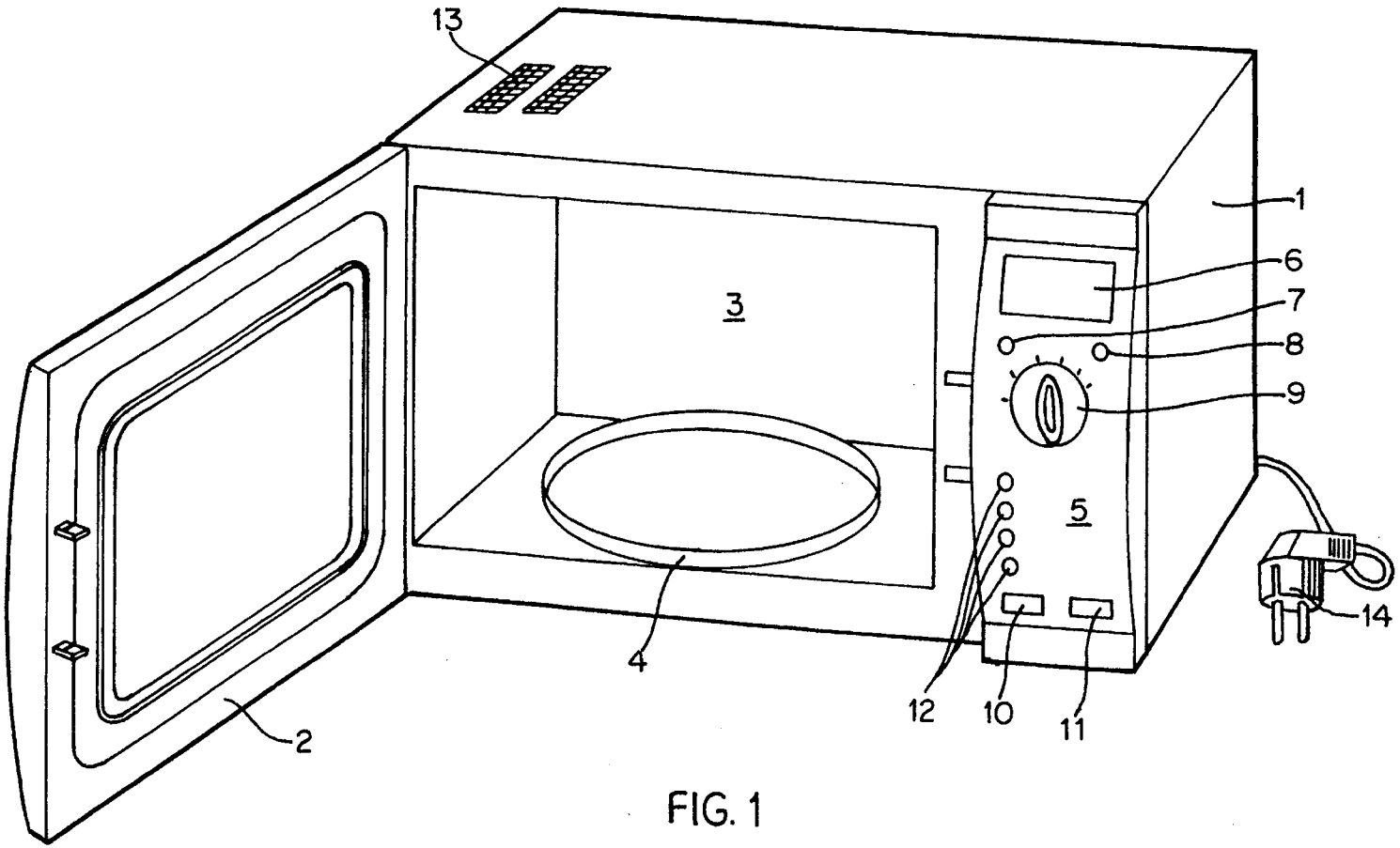
FIG. 1 shows a microwave oven according to the invention.

The microwave oven shown in FIG. 1 has an external casing 1 and an oven door 2 for closing the cavity 3, in which is arranged a rotary bottom plate 4. In one embodiment, the bottom plate may include a so-called crisp plate, which is of sheet aluminium of small thermal mass and whose underside is provided with a microwave-absorbing ferrite layer. SE Patent 9003104-8, as well as the applicant's microwave ovens of type designations VIP20 and VIP27, illustrates the construction of such a crisp plate and its rotary mechanism in more detail.

Figure 2:
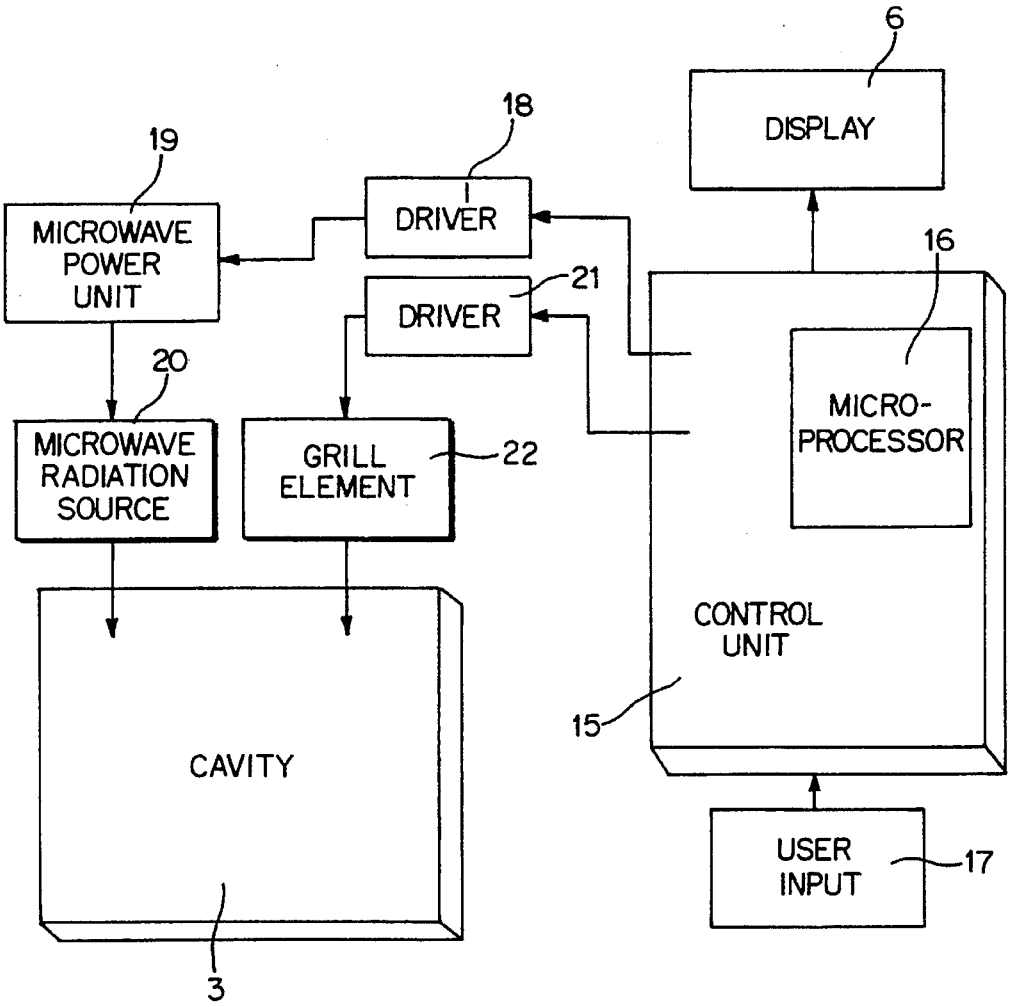
FIG. 2 shows cooperating functional units of the microwave oven in FIG. 1, which are related to the feeding of microwaves to the oven cavity.

The microwaves are fed to the cavity 3 through one or more feed openings (not shown), which communicate via wave guides with the microwave radiation source 20 (normally a magnetron) of the oven (see FIG. 2). In the illustrated oven, the magnetron, the associated wave guide system, the power unit 19 for operating the magnetron, and the control unit 15 are disposed behind the control panel 5. In a preferred embodiment of the microwave-feed system, use is made of an upper and a lower feed opening, which are provided in the right-hand lateral wall of the cavity, whereas the remainder of the feed system is designed to feed polarised microwaves through these openings. For more detailed information on the construction of the microwave-feed system, reference is made to SE Patent 9003012-3, as well as to the applicant's microwave ovens mentioned in the foregoing.

A grill element (not shown) may be arranged in the ceiling of the cavity, e.g. in the manner described in SE Patent 9201786-2. Instances of concrete designs are found in the applicant's microwave oven of type designation VIP20.

The illustrated microwave oven is designed for the selection between a given number of preprogrammed cooking or heating programs for specific types of food. In addition to these options, the oven can be used in conventional manner by selecting the desired cooking time and power level. When using the preprogrammed cooking or heating programs, the food or dish is heated through the interplay of direct-acting microwaves, bottom heat from the crisp plate, and top heat from the grill element. For more detailed information, reference is made to SE Patent Application 9402062-5.

The control panel 5 has a display 6 which, controlled by the control unit 15, shows, among other things, symbols or plain-text messages for selected programs and remaining cooking or heating time, i.e. verifies the user's selections made via the control panel, as well as provides other information on how the cooking or heating proceeds.

When the oven is used in conventional fashion, heating through the feeding of microwaves to the cavity is selected by means of the control button 7. The button 8 is used for activating the grill element of the oven, and the desired time is set by the knob 9. When the preprogrammed programs are used, the knob 9 may also be used for manual inputting of the weight of the food. The buttons 10 and 11 are used for, respectively, starting and switching off the oven. The keyset 12 is used for selecting the preprogrammed cooking or heating programs. All the buttons, as well as the knob and the display, are in communication with the control unit 15.

On the upper side of the oven, there are provided ventilation holes 13 communicating with the evacuation channel (not shown) of the cavity, which is disposed in the space between the ceiling of the cavity and the external casing 1. In view of single-phase connection to the mains, the oven has a flex 14 with a plug.

The block diagram of FIG. 2 shows the control unit 15 with a microprocessor and an associated program store 16. The user information is inputted to the control unit via the block 17, which represents the control buttons and the knob described above. The control unit controls the display 6. Via a driver 18 and the microwave power unit 19, the control unit 15 controls the microwave radiation source 20, and hence the feeding of microwaves to the cavity 3. Via a driver 21, the control unit 15 controls the grill element 22, and hence the IR radiation fed to the cavity 3. For more detailed information on the construction of these functional units, reference is made to the above-mentioned patents and microwave ovens manufactured by the applicant.

It should be emphasised that the microwave oven described above is but an example of a conceivable implementation of the method and the microwave oven according to the invention. Thus, the inventive method is generally applicable to every microwave oven in which the power level of the fed microwaves is controlled in the manner indicated by way of introduction. Naturally, each such application constitutes an implementation of the inventive microwave oven.

Figure 3:
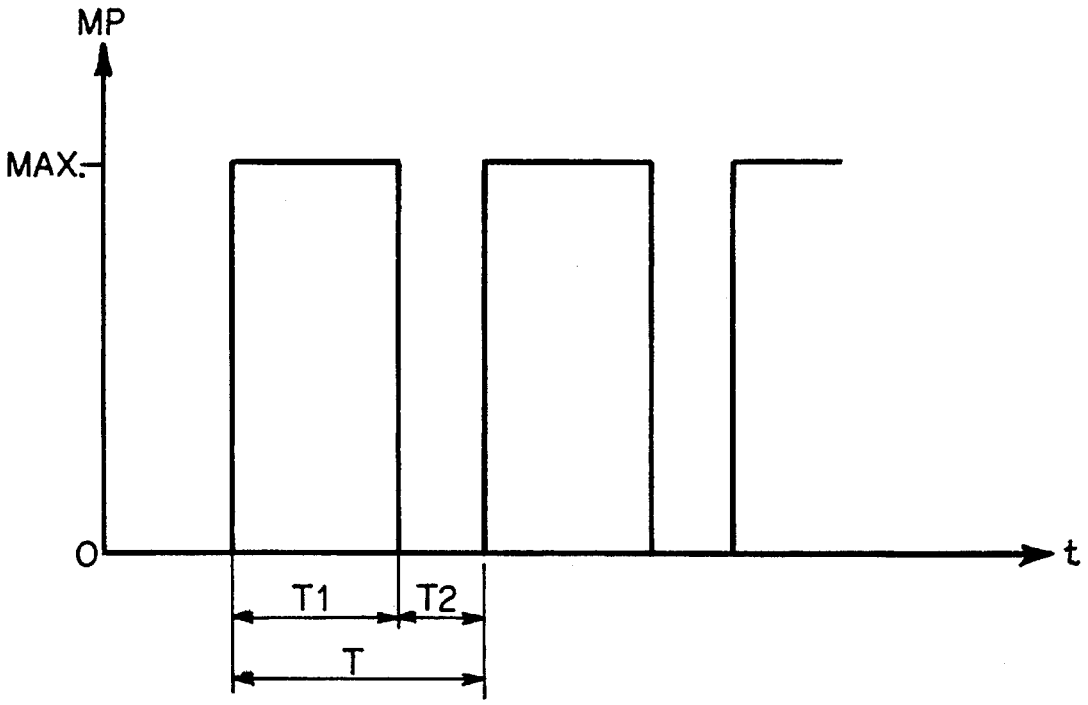
FIG. 3 is a time diagram illustrating the power-control method employed.

The time diagram of FIG. 3 illustrates the method of controlling the power level of the fed microwaves by on and off control of the microwave radiation source, i.e. the magnetron. The horizontal axis represents the time t, and the vertical axis represents the output power MP, which may vary between 0 and MPmax=full power. In today's magnetrons, full power is in the order of 1 kW.

The power control is performed by switching the magnetron during successive control cycles of the duration T. Each control cycle is divided into an activating period T1 with full output power from the magnetron, and a resting period T2 with an output power of 0. The following applies

| | |
|---|---|
| control-cycle duration | $T = T1 + T2$ |
| power level | $P = (T1/T) \cdot MP\text{max}$ |

Table I below illustrates how different power levels can be achieved when the control cycle has a duration T=20 sec. The power level P is given in per cent of full power MPmax.

TABLE I

| Power level P [%] | Activating time T1 [s] | Resting period T2 [s] |
|---|---|---|
| 25 | 5 | 15 |
| 50 | 10 | 10 |
| 75 | 15 | 5 |
| 100 | continuously | 0 |

Figure 4:
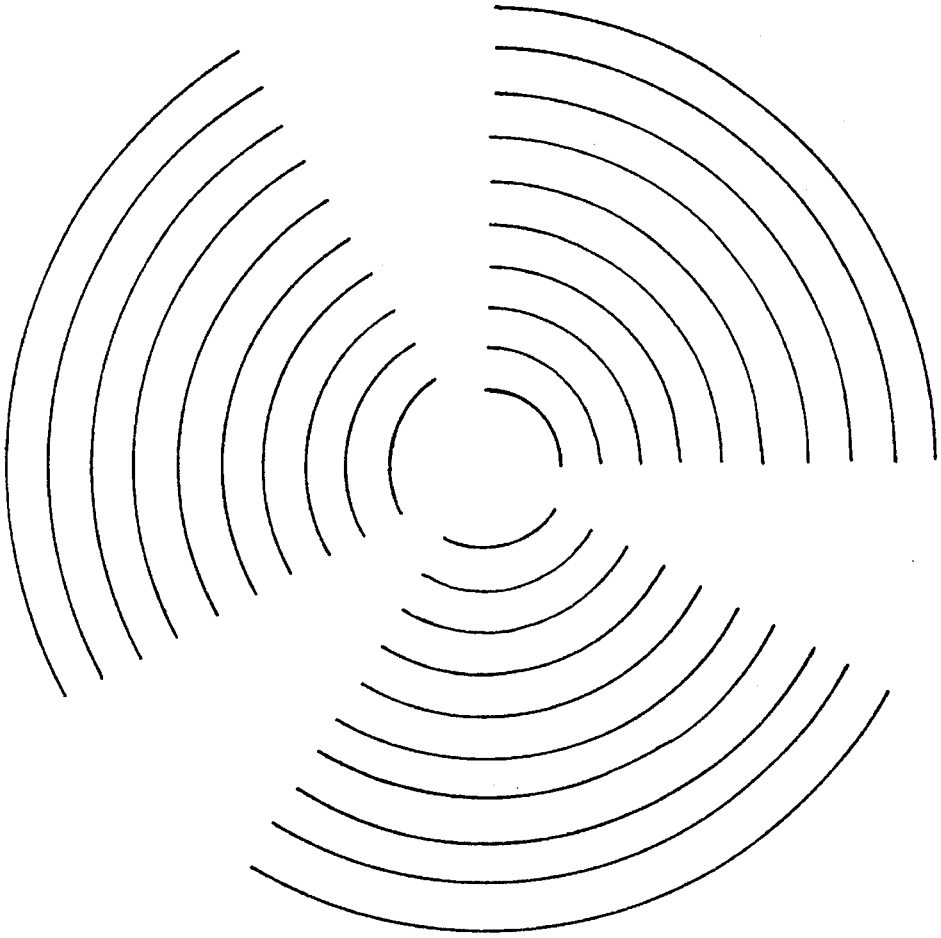
FIG. 4 illustrates the distribution of the intervals of microwave feed along the revolution of the bottom plate in a prior-art microwave oven.

FIG. 4 is intended to illustrate the problem of non-uniform heating in prior-art microwave ovens, which is due to the fact that the revolution time of the bottom plate is essentially in the same order as the duration of the control cycle used for the power control. In the Figure, the circular arcs represent the displacement of an imaginary point or part of the food or dish along a revolution of the bottom plate during the activating periods of the magnetron. Thus, each circular arc represents one activating period. The circular arcs have been given different diameters in order to illustrate the successive revolutions.

Assuming that the imaginary point or part of the food moves clockwise and counting outwards the Figure shows that the magnetron is activated through about 90° of the first revolution, that the point or part of the food then rotates one revolution+about 30°, that the magnetron then is activated through about 90°, that the point or part of the food rotates through a revolution+ about 30°, and so forth As shown in the Figure there are three sectors of about 30° each, through which the magnetron is not activated. As a result, no microwave energy will be fed to the imaginary point or part of the food when passing the corresponding parts of the cavity, which is the root cause of the non-uniform heating.

If the tendency of the oven to form the above-mentioned "hot" and "less hot" zones is, in addition, related to those parts of the cavity that correspond to the activating periods of the magnetron, this may contribute further to the non-uniformity of the heating.

As appears from FIG. 4, this problem is primarily due to the fact that the activating periods of the magnetron comprise but part of a revolution, i.e. are shorter than the revolution time. A possible solution would be to have an activating period equal to the revolution time, or optionally a multiple thereof. Such a solution functions satisfactorily when the heating times are fairly long. In the case of low power levels, however, such a solution involves an unfavourably long control-cycle duration. For instance, if the revolution time is 12 sec and the activating period is equal to the revolution time, a power level of 25% of full power would require a control-cycle duration of 48 sec. With such durations, the food or dish may cool down during the resting period of the control cycle, which of course prolongs the heating procedure.

Within the scope of the practical or mains operators' requirements placed on the selection of the duration of the control cycle and the revolution time of the bottom plate, it is therefore necessary to produce lower power levels by choosing such activating periods for the magnetron as are but part of the revolution time. In order to avoid the non-uniform heating illustrated in FIG. 4, one sees to it that the revolution sectors corresponding to the activating periods are evenly distributed over the revolution, e.g. by successive adjoining sectors, or by two successive sectors being located substantially diametrically in relation to one another, while the following two sectors each adjoin one of the preceding sectors, and so forth.

Table II below indicates related values for the activating period, the control-cycle duration and the power level. These values are calculated for an assumed revolution time for the bottom plate of 12 sec. As appears from the Table, the activating period equals the revolution time for power levels of 40% and upwards, whereas the activating periods are but part of the revolution time for lower power levels.

TABLE II

| Activating period T1 [s] | Control-cycle duration T [s] | Power level P [%] |
|---|---|---|
| 12 | 15 | 80 |
| 12 | 17.1 | 70 |
| 12 | 20 | 60 |
| 12 | 24 | 50 |
| 12 | 30 | 40 |
| 6 | 18 | 33 |
| 4 | 16 | 25 |
| 3 | 15 | 20 |

Figure 5:
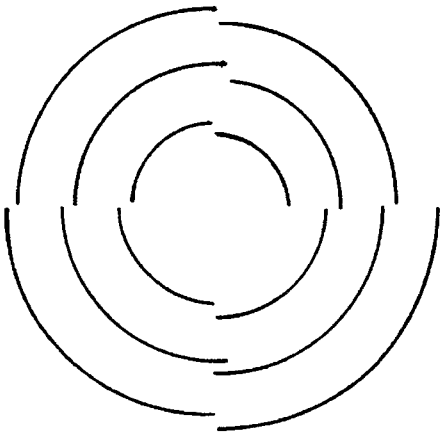
FIG. 5 illustrates the corresponding distribution in a microwave oven according to the invention.

FIG. 5 illustrates the case with a power level P=20% of full power. In that case, the following applies
control-cycle duration T=15 sec
revolution time of the bottom plate=12 sec
the activation period T1=3 sec.

As a result of these choices, the circle segments corresponding to the successive activating periods adjoin one another turn by turn. The activating periods are then evenly distributed over the bottom plate, and there are no "passive" sectors of the type shown in FIG. 4.

In the Example illustrated in FIG. 5, the heating time of the procedure has further been taken into consideration in view of optimising the heating procedure. That this is so is evident from the fact that there are, in FIG. 5, the same number of circle segments within each of the four sectors. The shorter the heating time, the greater the importance of this adjustment. One circle segment less within a certain sector would mean that less microwave energy were fed to the corresponding part of the food than to surrounding parts. It will be appreciated that a long heating time, involving many revolutions of the bottom plate, reduces the impact of such "uneven" energy supply on the heating uniformity. In the Example illustrated in FIG. 5, the control-cycle duration and the activating period selected are, in relation to the desired power level, optimal for a heating time consisting of a number of full minutes. That this is so is due to the fact that the activating periods occur in the same places of the revolution with a periodicity of four cycle durations, i.e. 4·15=60 sec. In order to achieve the aimed-at even distribution of the heating periods according to FIG. 5, the heating time should optimally equal an integer multiple of this repetition interval of the so-called heating pattern, or should be essentially equal to such an integer multiple.

Normally, the preprogrammed automatic heating or cooking procedures are divided into several steps with associated, different power levels and heating times. These steps are carried out immediately after one another in a predetermined sequence. Automatic thawing of deep-frozen food is an instance of such a program. Typically, the sequence comprises 3–5 steps, whose associated power levels and heating times are calculated by the microprocessor forming part of the control unit. According to the invention, further optimisation can be achieved by adjusting the heating times of the different steps to one another within the total heating time. By this measure, each step can be given a precisely adjusted heating time constituting precisely an integer multiple of the above-mentioned repetition interval for the heating pattern of the oven. The remainder of the heating time is introduced as passive time within the total heating time and may come last in the heating procedure.

It should be emphasised that a corresponding, mutual adjustment of the individual heating times of the steps can be performed also when the sequence of steps is chosen by the user.

As appears from Table II above, it is suitable, at lower power settings, to choose activating periods equal to 0.5 or 0.25 revolutions, resulting in a heating pattern that is repeated after a certain number of control-cycle durations. If, say, the power level is 33%, the food is heated through half a revolution of the bottom plate, and there is then a pause lasting a complete revolution. During the following activating period, the corresponding part of the bottom plate will be heated when located within the other half of the revolution. Consequently, the heating pattern is repeated after two control-cycle durations. The optimum heating time is then an even multiple of the repetition interval of this pattern, i.e. 2 control-cycle durations. Correspondingly, the optimum heating time at 25% of full power is an even multiple of 3 control-cycle durations.

When using related values according to Table II, an optimal adjusted heating time, in terms of control-cycle durations, can be calculated according to the following formula $$NT=(TR/T1)\cdot\text{integer part}\,[(TH/T)\cdot(T1/TR)] \quad (1)$$

wherein
T=control-cycle duration
NT=number of control-cycle durations
TR=revolution time
T1=activating period
TH=desired heating time Assuming that a procedure composed of the following sequence of steps is to be carried out

| | |
|---|---|
| step 1 | power level = 33%, heating time = 190 sec |
| step 2 | power level = 25%, heating time = 250 sec |
| step 3 | power level = 20%, heating time = 290 sec. |

This sequence involves a total heating time of 730 sec. Calculation then proceeds as follows.

Step 1

Heating time=190 sec

Activating period and control-cycle duration are chosen according to Table II and set at, respectively, 6 sec and 18 sec; the control-cycle duration=activating period/power level=6/0.33≈18 sec.

A heating pattern that is repeated after 2 control-cycle durations T is then obtained.

According to formula (1), one obtains:

$NT=(1/6)\cdot$integer part $[(190/18\cdot(6/12)]=10$

Adjusted heating time in step 1=

$=NT\cdot T=10\cdot 18=180$ sec

The remaining heating time in step 1=10 sec, which is passed on to step 2.

Step 2

Desired heating time=heating time step 2+remaining heating time step 1=250+10=260 sec Activating period and control-cycle duration are chosen according to Table II and set at, respectively, 4 sec and 16 sec.

A pattern that is repeated after 3 control-cycle durations is then obtained.

According to formula (1), one obtains:

NT=15

Adjusted heating time in step 2=15·16=240 sec

Remaining heating time in step 2=20 sec, which is passed on to step 3.

Step 3

Desired heating time=290+20=310 sec

Activating period and control-cycle duration are chosen according to Table II and set at, respectively, 3 sec and 15 sec.

A heating pattern that is repeated after 4 control-cycle durations is then obtained.

According to formula (1), one obtains:

NT=20

Adjusted heating time step 3=20·15=300 sec

Remaining heating time in step 3=10 sec, which is introduced as inactive time at the very end of the heating procedure.

It will be appreciated that those skilled in the art are well qualified to devise modifications of the inventive method and microwave oven that lie within the scope of the invention.

The above description and the appended claims deal throughout with a microwave oven comprising a rotary bottom plate, for the simple reason that such a bottom plate is used in existing microwave ovens. In principle, however, it is possible to use another type of bottom plate performing some other cyclic movement with a corresponding movement-cycle duration. Such a modification is but a measure of convenience, which means that the term "revolution time", used in the present application, is replaced with the term "movement-cycle time" and is to be regarded as encompassed by the inventive idea.

Further, those skilled in the art are well qualified to suggest other combinations of the distinctive features of the invention than those explicitly stated in the appended claims.

We claim:

1. A method of controlling, in a microwave oven, the feeding of microwaves to the oven cavity, the oven comprising a microwave radiation source and a control unit for controlling the microwave feed, means being arranged in the cavity for bringing about a periodically-varying microwave exposure of the food or dish during heating, defining a variation period, and a desired power level below full power of the fed microwaves being produced by periodic activation of the microwave radiation source during a control cycle that is part of a sequence of control cycles, the method comprising:

selecting the duration (T) of each control cycle and the variation period of the microwave exposure to improve heating uniformity, wherein this selecting includes synchronizing the periodic activation and the variation period such that a point on the food or dish is located within every sector of a revolution during essentially the same amount of the total activation time of the microwave radiation source during a heating procedure.

2. A method as set forth in claim 1, wherein said means arranged in the cavity are conceived as a rotary field agitator or aerial, a periodically-varying microwave exposure of the food Or dish being brought about by the rotation of the field agitator or aerial, and improving the heating uniformity by adjusting to one another the duration (T) of the control cycle and the revolution time of the field agitator or aerial.

3. A method as set forth in claim 1, wherein said means arranged in the cavity are conceived as a rotary bottom plate carrying the food or dish during heating, a periodically-varying microwave exposure being brought about by the rotation of the bottom plate, and improving the heating uniformity by adjusting to one another the duration (T) of the control cycle and the revolution time (TR) of the bottom plate.

4. A method as set forth in claim 3, wherein each control cycle is divided into an activating period (T1) and a resting period (T2), the power level (P) being determined by the relationship between said periods, the bottom plate being rotated with a constant revolution time (TR), and so choosing the duration (T) of the control cycle in relation to the revolution time (TR) of the bottom plate that the revolution sectors corresponding to the activating periods (T1) of the microwave radiation source are substantially evenly distributed over the bottom plate during a heating procedure.

5. A method as set forth in claim 4, and further comprising so choosing the duration (T) of the control cycle that the activating period (T1) during a control cycle corresponds to a revolution sector substantially adjoining the revolution sector corresponding to the immediately preceding activating period (FIG. 5).

6. A method as set forth in claim 4, and further comprising so choosing the duration (T) of the control cycle that the activating period (T1) during a control cycle corresponds to a revolution sector located substantially diametrically opposite to the revolution sector corresponding to the immediately preceding activating period.

7. A method as set forth in claim 4, and further comprising so choosing the duration (T) of the control cycle that the activating period (T1) substantially is an integer multiple of the revolution time (TR) of the bottom plate.

8. A method as set forth in claim 4, wherein different given power levels are selectable, and further comprising choosing the whole or part of the revolution time (TR) as activating period (T1), and obtaining each power level (P) by a corresponding adjustment of the duration (T) of the control cycle.

9. A method as set forth in claim 4, wherein the power level (P) is given, and further comprising choosing the duration (T) of the control cycle according to the given power level as well as the duration of the heating procedure.

10. A method as set forth in claim 4, wherein the heating procedure is composed of a sequence of steps with different power levels and associated heating times, and further comprising choosing the duration (T) of the control cycle according to the current power level (P) during each step of the sequence, and optimizing the heating uniformity by adjusting the heating times of the different steps to one another within the total heating time of the procedure.

11. A microwave oven comprising a cavity a microwave radiation source a control unit for controlling the feeding of microwaves to the cavity, and means arranged in the cavity for bringing about a periodically-varying microwave exposure of the food or dish during heating, defining a variation period, the control unit can produce a microwave power level below full power by periodic activation of the microwave radiation source during a control cycle that is part of a sequence of control cycles, wherein the duration (T) of each control cycle has such a relationship to the variation period of the means for periodically-varying microwave exposure that the periodic activation is synchronized with the variation period so a point on the food or dish is located within every sector of a revolution during essentially the same amount of the total activation time of the microwave radiation source.

12. A microwave oven as set forth in claim 11, wherein said means comprise a rotary field agitator or aerial whose rotation brings about a periodically-varying microwave exposure, and the duration (T) of the control cycle is related to the revolution time of the field agitator or aerial.

13. A microwave oven as set forth in claim 11, wherein said means comprise a rotary bottom plate which carries the food or dish during heating and whose rotation brings about a periodically-varying microwave exposure, and the duration (T) of the control cycle is related to the revolution time (TR) of the bottom plate.

14. A microwave oven as set forth in claim 13, wherein the control unit divides each control cycle into an activating period (T1) and a resting period (T2) for the microwave radiation source, the power level depending on the relationship between said periods, and the bottom plate being adapted to rotate at constant speed, and the control cycle has such a duration (T) that the revolution sectors corresponding to the activating periods (T1) of the microwave radiation source are substantially evenly distributed over the bottom plate during a heating procedure.

15. A microwave oven as set forth in claim 14, wherein the control cycle has such a duration (T) that successive activating periods (T1) correspond to substantially adjoining revolution sectors.

16. A microwave oven as set forth in claim 14, wherein the control cycle has such a duration (T) that successive activating periods (T1) correspond to substantially diametrically opposite revolution sectors.

17. A microwave oven as set forth in claim 14, wherein the microwave oven provides for the selection of preprogrammed automatic heating procedures composed of a sequence of steps with different power levels (P) and associated heating times, the duration of the activating period (T1) during each step equals the revolution time or a multiple or part thereof, the control cycle during each step has a duration (T) adjusted to the activating period (T1) and giving the desired power level (P), and the heating times of the steps are adjusted to one another within the total heating time of the procedure in order to optimize the heating uniformity.

18. A microwave oven as set forth in claim 17, wherein the control unit comprises a microprocessor with an associated program store, the duration of each activating period (T1) equaling a part of the revolution time (TR), and the microprocessor, for each step, is programmed to, establish the repetition interval, in terms of control-cycle durations (T), at which the activating periods (T1) occur at the same places of the revolution, choose an adjusted heating time equal to an integer multiple of said repetition interval within the heating time of the step, add the remainder of the heating time to the heating time of the following step, and introduce the heating time remaining from the last step of the sequence as inactive time within the total heating time.

19. A microwave oven as set forth in claim 17 wherein related values of power levels (P), control-cycle durations (T) and activating periods (T1) are stored in tabular form in the program store.

* * * * *